United States Patent [19]

Murphy

[11] Patent Number: 4,680,247

[45] Date of Patent: Jul. 14, 1987

[54] PHOTOGRAPHIC PROCESSING COMPOSITION WITH POLY(DIACETONE ACRYLAMIDE) OXIME AND STYRENE-BUTADIENE LATEX

[75] Inventor: Richard J. Murphy, Dennis Port, Mass.

[73] Assignee: Polaroid Corporation, Patent Dept., Cambridge, Mass.

[21] Appl. No.: 846,587

[22] Filed: Mar. 31, 1986

[51] Int. Cl.[4] ..... G03C 5/54; G03C 5/26

[52] U.S. Cl. ..... 430/215; 430/212; 430/220; 430/227; 430/444; 430/466

[58] Field of Search ..... 430/14, 227, 212, 220, 430/444, 466, 215, 214

[56] References Cited

U.S. PATENT DOCUMENTS

| | | | |
|---|---|---|---|
| 2,537,114 | 1/1951 | Young et al. | 117/155 |
| 2,685,538 | 8/1954 | Stinchfield et al. | 117/155 |
| 2,685,571 | 8/1954 | Stichfield et al. | 260/8 |
| 3,597,197 | 8/1971 | Milligan | 430/212 |
| 3,679,409 | 7/1972 | Buckler et al. | 430/214 |
| 4,179,538 | 12/1979 | Sassenhausen | 430/213 |
| 4,202,694 | 5/1980 | Taylor | 430/215 |
| 4,324,853 | 4/1982 | Berger | 430/245 |
| 4,397,996 | 8/1983 | Chiklis et al. | 525/380 |

OTHER PUBLICATIONS

Trade publication, Darex ® Copolymer Latexes, 508L, W. R. Grace & Co., Mar. 1983.

Trade publication, Darex ® Copolymer Latexes, 510L, W. R. Grace & Co., Mar. 1983.

*Primary Examiner*—Richard C. Schilling

*Attorney, Agent, or Firm*—Louis G. Xiarhos

[57] ABSTRACT

Photographic processing compositions containing a light-reflecting pigment and a styrene-butadiene copolymer are disclosed. The photographic processing compositions are useful in photographic diffusion transfer film units and processes for the provision of permanent photographic laminates. A light-reflecting layer formed in a photographic laminate from such a processing composition exhibits a reduced tendency toward cohesion or adhesion failure and separation.

9 Claims, 2 Drawing Figures

PHOTOGRAPHIC PROCESSING COMPOSITION WITH POLY(DIACETONE ACRYLAMIDE) OXIME AND STYRENE-BUTADIENE LATEX

BACKGROUND OF THE INVENTION

This invention relates to photographic products and processes adapted to the provision of photographic images by diffusion transfer processing. More particularly, it relates to photographic processing compositions, film units and processes adapted to the provision of a diffusion transfer image retained within a permanent laminate and viewable through a transparent support against a reflecting background.

Diffusion transfer photographic products and processes have been described in the art and details relating to such products and processes can be found in numerous patents including, for example, in U.S. Pat. Nos. 2,983,606; 3,415,644; 3,594,165; and 3,647,437; and in Great Britain Pat. No. 1,220,524. In general, diffusion transfer photographic products and processes involve film units having a photosensitive system including at least one silver halide emulsion layer usually integrated with an image-providing material. After photoexposure, the photosensitive system is developed to establish an imagewise distribution of a diffusible image-providing material, at least a portion of which is transferred by diffusion to an image-receiving layer capable of mordanting or otherwise fixing the transferred image-providing material. In some diffusion transfer products, the transfer image is viewed by reflection after separation of an image-receiving element from the photosensitive system. In other products, such separation is not required and the transfer image is viewed against a reflecting background, usually provided by a dispersion of a white, light-reflecting pigment such as titanium dioxide.

A number of photographic products and processes have been proposed for providing diffusion transfer photographic images retained as part of a permanent laminate. Typically, a photographic laminate will comprise a pair of outer polymeric layers, e.g., polyester, having therebetween a developed photosensitive system and a suitable image-carrying layer. In such photographs, the image-carrying layer is separated from the developed silver halide photosensitive system by a light-reflecting layer (e.g., a layer containing titanium dioxide positioned between the developed silver halide emulsion system and the image-carrying layer) and at least one of the outer polymeric layers is transparent to permit viewing of the photographic image against the light-reflecting layer. Diffusion transfer photographic products which provide a permanent photographic laminate as described are known in the art as "integral negative-positive film units" and illustrations thereof can be found, for example, in the above-noted U.S. Pat. Nos. 3,415,644; 3,594,165; and 3,647,437.

In the processing of certain preferred diffusion transfer film units adapted to the provision of a permanent photographic laminate, it has been customary to effect photographic development with the aid of an aqueous alkaline processing composition including a light-reflecting agent, e.g., titanium dioxide. Such a processing composition is typically spread from a rupturable container by passage of the film unit between a pair of rollers so as to distribute a layer of processing composition between the sheet elements of the film unit. The distributed layer of processing composition upon drying forms a light-reflecting layer which provides a background for viewing of the photographic image and serves to bond the layers of the film unit together to form the desired permanent laminate. Photographic processing compositions suited to such purposes are described, for example, in the aforesaid U.S. Pat. Nos. 3,415,644; and 3,647,437. As is pointed out in these patents, a viscosity-increasing agent is usually included in such processing compositions to facilitate uniform spreading of the composition, e.g., a polymeric film-forming material such as hydroxyethyl cellulose or carboxymethyl cellulose.

Photographic processing compositions including a polymeric oxime viscosity-increasing agent are described in U.S. Pat. No. 4,202,694 (issued May 13, 1980 to L. D. Taylor). While the polymeric oxime viscosity-increasing agents of the patent afford certain advantages as described therein, and notably from the standpoint of permitting favorable dye transfer rates in diffusion transfer processing, adhesion or cohesion failures in the dried light-reflecting layer formed from the distributed processing composition may be observed. Typically, the adhesion or cohesion failure will result from physical abuse of the photographic laminate, such as may be induced by bending, folding or curling the photograph.

Generally, the photographic laminate will be provided with a suitable frame or border which, for example, may be comprised of fold-around tape fastened about the perimeter of the photographic laminate to the top and bottom laminar elements, or which may comprise rail elements adhered between the laminar elements about the perimeter of the photograph.

The frame has an aesthetic purpose, provides a measure of rigidity or reinforcement to the photographic laminate and serves to confine the laminar elements of the photograph within a border which prevents easy separation of the laminated elements. Physical abuse of the photograph may nonetheless cause a separation or delamination of the image-receiving element from the deposited and dried light-reflecting layer. Adhesion failure may be manifested in the photographic laminate by an apparent pillowing effect. Moreover, discontinuities, resulting from a cohesion failure in the light-reflecting layer (manifested by localized and preferential adhesion of light-reflecting material to the separated image-receiving element), may also be observed.

Attempts to alleviate the problems associated with adhesion or cohesion failure may in turn result in loss of certain advantages, e.g., favorable dye transfer. It will be appreciated that the reduction of such separation or delamination occurrences without adverse influence on favorable dye diffusion transfer is to be desired.

SUMMARY OF THE INVENTION

It has been found that cohesion and adhesion failures in a permanent photographic laminate having a light-reflecting layer between the laminar elements thereof and against which a diffusion transfer image is viewed, can be alleviated by including, in a photographic processing composition containing a polymeric oxime viscosity-increasing agent and a light-reflecting pigment, an effective amount of a styrene-butadiene copolymeric latex. Thus, a styrene-butadiene copolymeric latex is added to a photographic processing composition including a polymeric oxime viscosity-increasing agent and a light-reflecting agent to provide a processing composition adapted to utilization in a photographic film unit for the production of a light-reflecting layer in a permanent photographic laminate. Favorable rates of dye transfer through the processing composition layer are realized while providing a background for the viewing of the desired image with substantially reduced or eliminated occurrences of separating or delamination of the laminar elements of the permanent photographic laminate.

In one of its product aspects, the present invention provides a photographic processing composition comprising an aqueous alkaline medium having therein: a polymeric oxime viscosity-increasing agent; a light-reflecting pigment; and a styrene-butadiene copolymeric latex.

In another of its product aspects, the present invention provides a photographic product for forming a diffusion transfer image within a permanent laminate which includes at least one developed silver halide layer. Such a product comprises, in combination, at least one photosensitive silver halide emulsion layer, each said silver halide emulsion having associated therewith an image-forming material; an image-receiving layer; and a photographic processing composition adapted to be distributed between the silver halide layer or layers and the image-receiving layer and effective to develop the silver halide emulsion or emulsions after photoexposure and form a transfer image in said image-receiving layer and effective to mask the developed silver halide layer or layers and provide a light-reflecting background for the viewing of said transfer image, said photographic processing composition comprising an aqueous alkaline medium having therein: a polymeric oxime viscosity-increasing agent, a light-reflecting pigment and a styrene-butadiene copolymeric latex; and a transparent support through which the transfer image may be viewed against the light-reflecting layer. Such a product upon processing provides a photographic laminate, also termed an integral negative-positive reflection print. The photographic laminate comprises the several aforesaid layers permanently laminated together and includes the light-reflecting layer formed by the spreading of the processing composition as aforedescribed.

DETAILED DESCRIPTION OF THE INVENTION

Figure 1:
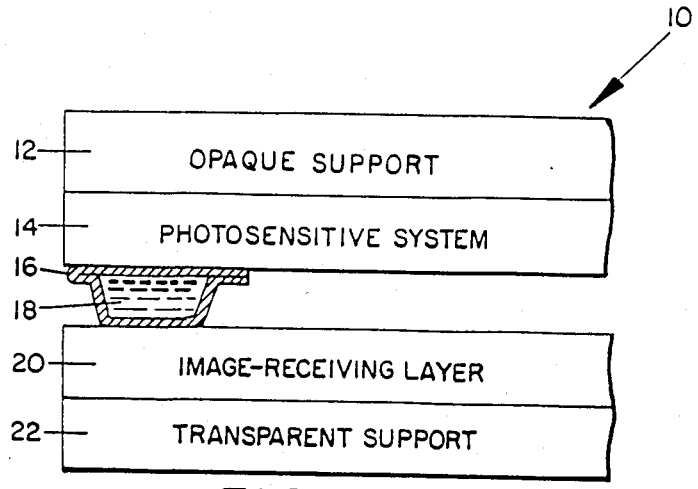
In FIG. 1 is shown a simplified or schematic view of an arrangement of essential elements of a preferred film unit of the present invention.

As noted above, this invention is concerned with photographic diffusion transfer products and processes, notably color diffusion transfer products and processes, wherein the layer containing the diffusion transfer image, i.e., the image-receiving layer, is not separated from the developed photosensitive layers after processing but is retained with the developed photosensitive layers as part of a permanent laminate. Film units particularly adapted to provide such a diffusion transfer image are often referred to as "integral negative-positive" film units. The resulting image may be referred to as an "integral negative-positive reflection print", and as so used, this expression is intended to refer to a reflection print wherein the developed photosensitive layers have not been separated from the image layer, i.e., the layer containing the transfer dye image. A light-reflecting layer including a light-reflecting pigment, a polymeric oxime binder or matrix material and a styrene-butadiene copolymer latex is positioned in the laminate between the developed photo-sensitive layer or layers and the image-carrying layer and serves to mask the developed photosensitive layer or layers and provides a light-reflecting background against which the photographic image can be viewed. These layers are part of a permanent laminate which includes outer or support layers at least one of which is transparent to permit the viewing therethrough of the photographic image.

The light-reflecting layer as aforedescribed is provided in the photographic laminate as the result of the spreading, between the photographic emulsion layer (or layers) and the image-receiving layer of the photographic film unit, a processing composition including the light-reflecting pigment, polymeric oxime and styrene-butadiene copolymer latex as aforedescribed. The layer of processing composition distributed during processing of the film unit upon drying forms the light-reflecting layer which serves to bond the layers of the film unit together in forming the desired permanent laminate. The present invention is particularly concerned with the nature of the photographic processing composition utilized in the photographic film units of the invention and the light-reflecting layer provided therefrom in the desired and resulting permanent laminate or integral negative-positive reflection print.

The light-reflecting pigments employed in the processing compositions of the invention include any of a variety of light-reflecting pigments suited to the provision of a white background for the viewing thereagainst of a diffusion transfer photographic image. The light-reflecting pigment serves in addition to mask the developed silver halide emulsion layer or layers and helps to provide opacification protection for the developing emulsion layer or layers in the event in-light processing of a film unit is desired. While titanium dioxide is preferred, other suitable light-reflecting pigments are known and include barium sulfate, zinc oxide, alumina, zirconium oxide or the like, as described, for example, in aforementioned U.S. Pat. No. 3,647,437. Mixtures of these light-reflecting pigments can be suitably employed. In general, the light-reflecting pigment will constitute a major component of the processing composition. Thus, an amount by weight of the processing composition of at least about 25% will generally be employed. Preferably, the light-reflecting pigment will be in the range of about 35% to about 60% by weight.

The polymeric oxime provides important functions in the processing compositions of the invention. Thus, the polymeric oxime provides viscosity-increasing properties importantly related to the uniform spreading of the processing composition between photosensitive and image-receiving elements of a diffusion transfer film unit. As is disclosed in the aforesaid U.S. Pat. No. 4,202,694 of L. D. Taylor, the polymeric oximes exhibit stability under the alkaline conditions of a photographic processing composition and provide desired viscosity-increasing properties while permitting the attainment of favorable dye transfer rates. The polymeric oximes utilized herein are polymers having at least one pendant or terminal substituent of the general formula:

$$-\overset{|}{C}=N-OH$$

This substituent may be linked to a polymeric backbone through various divalent radicals, e.g., aliphatic radicals such as alkylenes having, for example, 1 to 16 carbon atoms, arylene radicals of the benzene or naphthalene series, aralkylene, aliphatic or aromatic amides or the like, including substituted derivatives thereof. The particular nature of the polymeric oxime can vary consistent with the utilization of a polymeric oxime exhibiting stability under the highly alkaline conditions of the processing composition medium and dispersibility in the processing composition medium.

The polymeric oximes useful in the processing composition of the invention include homopolymers of compounds having at least one substituent of the formula $$-\overset{|}{C}=N-OH$$

and copolymers with copolymerizable monomers. Preferably, the polymeric oximes exhibit a high pKa, e.g., at least about 12. Especially useful are homopolymers and copolymers including on the polymeric backbone a substituent of the formula:

$$-\underset{\underset{O}{\|}}{C}-NH-\overset{R^1}{\overset{|}{\underset{\underset{R^1}{|}}{C}}}-(\text{alkylene})_{m-1}\underset{\underset{R^2}{|}}{C}=N-OH$$

wherein each $R^1$ is alkyl of 1 to 6 carbon atoms, preferably methyl or ethyl; "alkylene" is of 1 to 8 carbon atoms and may be straight or branched chain; $R^2$ is hydrogen, amino, phenyl or alkyl of 1 to 4 carbon atoms and m is 1 or 2. It will be understood that where m is 1, the "alkylene" moiety is not present.

Particularly useful polymeric oximes are the polymers including recurring units having the following formula:

$$\left(CH_2-\underset{\underset{\underset{O}{\|}}{C}-NH-\overset{R^1}{\overset{|}{\underset{\underset{R^1}{|}}{C}}}-(\text{alkylene})_{m-1}\underset{\underset{R^2}{|}}{C}=N-OH}{|}\right)$$

wherein each $R^1$ is alkyl of 1 to 6 carbon atoms, preferably methyl or ethyl; "alkylene" is of 1 to 8 carbon atoms and may be straight or branched chain; $R^2$ is hydrogen, amino, phenyl or alkyl of 1 to 4 carbon atoms; and m is 1 or 2. Within this class of polymers, preferred are those wherein $R^2$ is methyl; m is 2; and "alkylene" has one carbon atom, i.e., is methylene. A preferred polymer is poly(DAA)oxime, i.e., poly(diacetone acrylamide) oxime which is comprised of recurring units of the formula $$\left(CH_2-\underset{\underset{\underset{O}{\|}}{C}-NH-\overset{CH_3}{\overset{|}{\underset{\underset{CH_3}{|}}{C}}}-CH_2-\overset{N-OH}{\overset{\|}{C}}-CH_3}{|}\right)$$

Suitable copolymeric oximes include recurring units having at least one pendant oxime moiety as described hereinbefore and recurring units from an ethylenically unsaturated monomer such as acrylic acid, methacrylic acid, 2-acrylamide-2-methylpropanesulfonic acid or the like. The copolymers can also be graft copolymers which have a grafted moiety including a substituent of the formula $$-\overset{|}{C}=N-OH$$

grafted onto a polymeric backbone material capable of being oxidized in known manner with formation of reactive sites for the grafting of the compound having the —C=N—OH substituent. If desired, a graft copolymer having an aldehyde or ketone group, i.e., a polymer having an oxime precursor group, can be first prepared, and thereafter oximated to provide the desired oxime polymer. Preferred graft copolymers are the oximated grafts of diacetone acrylamide (DAA) onto a backbone polymer of hydroxyethyl cellulose (HEC). A suitable example is a polymer wherein DAA and 2-acrylamido-2-methylpropane sulfonic acid are grafted onto a hydroxyethyl cellulose (HEC) polymer and the resulting polymer is subjected to oximation.

Oxime homopolymers and copolymers can be prepared by resort to solution polymerization or emulsion polymerization techniques or by use of methods employed for the preparation of graft copolymers. Suitable methods and oxime polymers prepared therefrom are described in detail in the aforesaid U.S. Pat. No. 4,202,694 (issued May 13, 1980), incorporated by reference.

Another preferred polymeric oxime viscosity-increasing agent is a polymeric oxime prepared by a process whereby a latex is prepared by a semi-continuous emulsion polymerization of an aldehyde or ketone such as diacetone acrylamide, along with any copolymerizable monomers such as acrylic acid, and the latex is swollen with an alcohol such as methanol and oximated utilizing hydroxylamine salt. Such a polymeric oxime, a process for preparing the oxime and photographic processing compositions containing same are described in greater detail in the U.S. Pat. No. 4,397,996 issued Aug. 9, 1983 to C. K. Chiklis and A. N. Schuler.

The amount of the polymeric oxime utilized in the photographic processing compositions hereof can vary depending upon the particular oxime polymer. In general, the polymeric oxime should be utilized in as small an amount as is sufficient to provide the desired viscosity. It should be understood that the use of amounts greater than required to provide satisfactory viscosity results may tend to impede dye transfer through the distributed layer of processing composition with resulting losses in rate of dye transfer. Thus, the amount of polymeric oxime employed should be minimized where maximum dye transfer rate is an important consideration. In general, the oxime will be employed in a processing composition of the invention in an amount by weight of the composition of up to about 2%, and preferably, in the range of about 0.5% to 1%. In the case, for example, of poly(DAA)oxime, the oxime will be present in an amount up to about 2%, and preferably, from the standpoint of preferred dye transfer rates, in an amount in the range of about 0.5% to about 1%.

The styrene-butadiene copolymeric latex incorporated into the photographic processing composition provides an important function in minimizing occurrences of adhesion and/or cohesion failure. This performance is believed to be attributable to the promotion of an improved bonding of the light-reflecting layer (which is formed by the spread and dried processing composition) to each of the laminar elements which comprise the photographic laminate. Styrene-butadiene copolymeric materials suited to this purpose are known and readily available. Particularly suitable are the styrene-butadiene copolymers in the form of an aqueous emulsion or latex. Typically, such emulsions or latices are prepared in known manner by the emulsion copolymerization of styrene and butadiene, using an emulsion polymerization surfactant and a polymerization initiator. Methods for their production are known and are described, for example, in U.S. Pat. Nos. 2,537,114; 2,685,538; and 2,685,571.

The proportions of styrene and butadiene units in the copolymeric latex particles can vary depending upon the amount of cohesiveness or adhesive properties required, upon the particular nature of the processing composition in which the copolymeric latex is to be incorporated and on the nature of the layers to which the spread and dried processing composition (light-reflecting) layer is to be contiguous. In general, the ratio of styrene to butadiene will be in the range of from about 0.75:1 to about 3:1, and preferably, in the range of from about 1:1 to about 2:1.

Styrene-butadiene copolymers in the form of latices are commercially available and typically will contain the copolymeric latex particles in an aqueous medium at a solids content of about 40 to 60%. Examples of suitable commercially available copolymeric latices include Darex® 508L and 510L carboxylated sytrene-butadiene copolymeric latices wherein the approximate ratio of styrene-butadiene units is 67:33 and the solids content is 55% (commercially available from W. R. Grace & Co.); and Dow 620 carboxylated styrene-butadiene latex wherein the approximate ratio of styrene to butadiene is 67:33 and the solids content is 50% (commercially available from Dow Chemical Company).

The styrene-butadiene copolymeric latex can contain additional copolymerized units such as acrylic, itaconic or crotonic acid or other copolymerized units which promote latex stability. Preferred latices are the carboxylated styrene-butadiene copolymeric latices such as are exemplified by the aforementioned commercially available latices. It will be appreciated that the commercially available styrene-butadiene latices may vary with respect to one another and may contain various adjuvants such as emulsifiers, surfactants, defoaming agents or the like, incorporated for various purposes related to the applications to which these latices are typically addressed. Good results in the photographic laminates of the invention can, however, be achieved with any of the aforementioned commercially available Darex® 508L and 510L and Dow 620 carboxylated styrene-butadiene latices.

The amount of styrene-butadiene copolymer utilized in the processing compositions of the invention can vary with the nature of the processing composition, particularly the nature and amounts of the light-reflecting pigment and polymeric oxime employed. A minor amount up to about 6% of the styrene-butadiene copolymer can be employed to provide improved adhesion of the laminar elements of the photographic laminate to the light-reflecting layer. In general, the amount of styrene-butadiene copolymer will be an amount sufficient to provide desired protection against separation or delamination and an amount less than that which tends to undesirably influence the diffusion of dye or image-forming material through the spread processing composition layer to the image-receiving layer. Depending upon the particular styrene-butadiene copolymeric latex employed, an amount of at least about 1% will be employed to provide improved laminations. Amounts greater than about 6%, while effective to confer improved bond strengths, tend to affect dye diffusion transfer. A desirable balance of impoved bond strengths and good sensitometric performance can generally be realized by employing an amount in the range of about 1.5% to 3%.

The amount of styrene-butadiene latex employed in the processing composition may also be influenced by the nature of the support materials utilized in the photographic film units and, particularly, the thickness of sheet materials used as supports for the photosensitive and image-receiving elements. The thickness of such supports will influence the degree to which the photographic laminate may be readily flexed or folded and, thus, will influence the ease with which an undesired delamination may result. A propensity for delamination may also be enhanced by a substantial difference in thickness between the respective outer supports of the photographic laminate. Where, for example, a relatively thin (e.g. 0.064 to 0.069 mm.) polyester support material is employed as the support for the image-receiving element and is laminated to a photosensitive element having a polyester support of 0.01 mm. thickness, the resulting photographic laminate will tend to be more easily flexed relative to a laminate wherein a thicker (e.g., 0.10 mm) support material is used in the image-receiving element; and in the former case, it may be desirable to employ an increased amount of the styrene-butadiene latex as a means of counterbalancing the increased flexibility of the laminate. The amount should, however, be increased consistent with the requirement of satisfactory photographic performance.

The processing compositions of the invention are aqueous alkaline compositions having a pH in excess of about 12, and frequently in the order of 14 or higher. These compositions comprise an aqueous alkaline medium comprising sodium hydroxide, potassium hydroxide or other alkaline material or materials suited to the provision of a pH within the range of about 12 to 14 or higher. The compositions can additionally include known silver halide developing agents, development restrainers, opacification dyes, tint dyes and other photographic agents typically included in such compositions. For example, opacification dyes such as are described in U.S. Pat. No. 3,647,347 can be employed. The compositions can be incorporated into rupturable or frangible containers to facilitate spreading in diffusion transfer processing. Examples of suitable rupturable containers and their methods of manufacture can be found, for example, in U.S. Pat. Nos. 2,543,181; 2,634,8865; 3,653,732 and 3,056,491.

The styrene-butadiene copolymer can be incorporated into the processing composition in a variety of manners. Inasmuch as the copolymeric latex may undergo swelling or show sensitivity to the concentration of alkali normally required to provide a pH in excess of about 12, it will be preferred in formulating the processing composition to avoid addition of the styrene-butadiene latex to a processing composition containing the total amount of alkali to be employed in the compositon. Good results can be obtained by preparing a premix of water, a portion of the total amount of alkali, the polymeric oxime, the styrene-butadiene latex and photograhic agents and, then, adding the remaining portion of alkali. Other addition sequences can, however, be employed.

The photographic processing compositions of the invention can be employed in a variety of diffusion transfer processes. The arrangement and order of the individual layers of film units used in such processes can vary in manners known in the art, provided the final photograph is a laminate wherein the desired image is viewed through a transparent support, e.g., an integral negative-positive reflection print as described above. For convenience the more specific descriptions of the invention hereinafter set forth will be by use of particular dye-image providing materials in a diffusion transfer color process and of integral negative-positive film units of the type contemplated in previously mentioned patents. Details relating to integral negative-positive film units of the type herein can be found, for example, in U.S. Pat. Nos. 3,415,644 and 3,647,437. It will be readily apparent from such descriptions that various image-forming reagents may be used, e.g., dye developers, color couplers, coupling dyes, or compounds which release a diffusible dye or dye intermediate as a result of coupling, oxidation or silver ion-assisted cleavage.

Referring now to the drawing, FIG. 1 shows a photographic diffusion transfer film unit of the invention adapted to the provision of an integral positive-negative photographic laminate. The film unit 10 includes a photosensitive element comprising an opaque support 12 carrying a photosensitive system 14 which may include one or more photosensitive layers. Film unit 10 includes an image-receiving element comprising a transparent support material 22 carrying an image-receiving layer 20. The nature of support materials 12 and 22 can vary among a class of known polymeric sheet materials. A preferred support material is polyethylene terephthalate. Positioned between the photosensitive and image-receiving elements is shown a rupturable container 16 containing a processing composition 18 of the invention. After photoexposure of photosensitive system 14 through transparent support 22 and image-receiving layer 20 as shown, film unit 10 can be passed between a pair of camera rolls so as to uniformly distribute processing composition 18 between photosensitive system 14 and image-receiving layer 20.

Figure 2:
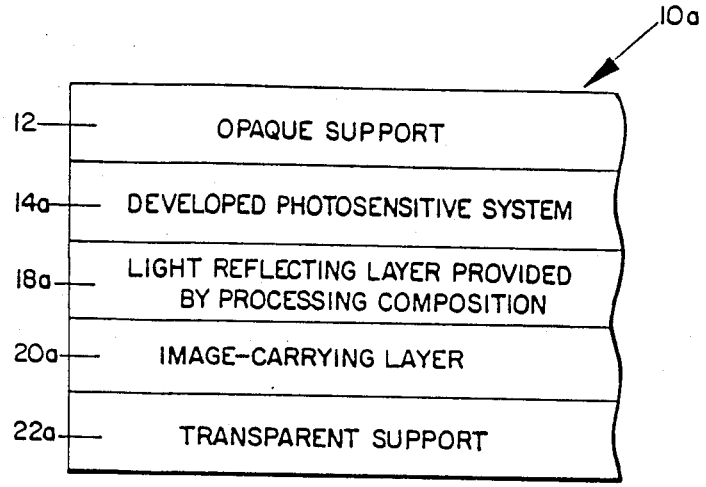
In FIG. 2 is shown a simplified or schematic view of a photographic laminate of the invention formed by the processing of the film unit of FIG. 1.

In FIG. 2 is shown a photographic laminate of the invention 10*a* formed by exposure and processing of film unit 10 of FIG. 1. When processing composition 18 of FIG. 1 is distributed over photosensitive system 14, development of photoexposed photosensitive system 14 is initiated to establish an imagewise distribution of diffusible image-providing material which can comprise one or more dye or dye intermediate image-providing materials. The spreading of processing composition 18 provides light-reflecting layer 18*a*. The diffusible image-providing material is transferred through permeable, light-reflecting layer 18*a* where it is mordanted, precipitated or otherwise retained in image-carrying layer 20*a*. Image layer 20*a* is viewed through transparent support 22 against light-reflecting layer 18*a*.

The light-reflecting layer 18*a* provided by the embodiment of the invention shown in FIG. 2 is formed by solidification of the stratum of processing composition distributed after exposure. The processing composition will include the polymeric oxime, light-reflecting and styrene-butadiene copolymeric latex materials described hereinbefore. Absorption of water from the applied layer of processing composition results in a solidified light-reflecting layer 18*a* which permits the viewing thereagainst of image layer 20*a* through transparent support 22. In addition, light-reflecting layer 18*a* serves to laminate together the developed photosensitive system 14*a* and the image-bearing layer 20 to provide the final photographic laminate 10*a*.

In accordance with one embodiment of the invention, a photographic film unit can comprise a temporary laminate including the several layers of the photographic film unit confined between two suitable supports and having the bond between a predetermined pair of layers being weaker than the bond between other pairs of layers. Thus, with reference to FIG. 1, image-receiving layer 20 can be temporarily bonded to the silver halide emulsion layer 14 prior to exposure. The rupturable container or pod 16 can then be positioned such that, upon its rupture, the processing composition will delaminate the temporary bond and be distributed between the aforesaid layers 14 and 20. The distributed layer of processing composition upon drying forms light-reflecting layer 18*a* which serves to bond the layers together to form the desired permanent laminate. Procedures for forming such prelaminated film units, i.e., film units is which the several elements are temporarily laminated together prior to exposure, are described, for example, in U.S. Pat. No. 3,625,281 issued to Albert J. Bachelder and Frederick J. Binder and in U.S. Pat. No. 3,652,282 to Edwin H. Land, both issued Mar. 28, 1972. A particularly useful and preferred prelamination utilizes a water-soluble polyethylene glycol as described and claimed in U.S. Pat. No. 3,793,023, issued Feb. 19, 1974 to E. H. Land.

If desired, the film unit shown in FIG. 1 may utilize a transparent support instead of the opaque support 12 shown therein. In accordance with this alternative embodiment, an opaque layer, e.g., pressure-sensitive, should be superposed over said transparent support to avoid further exposure through the back of the film of the film unit during processing outside of the camera. In the embodiment illustrated in FIG. 1, photoexposure is effected through the image-receiving element. While this is a particularly useful and preferred embodiment, it will be understood that the image-receiving element may be initially positioned out of the exposure path and superposed upon the photosensitive element after photoexposure, in which event the processing and final stages would be the same as in FIG. 1.

The film unit illustrated in FIG. 1 has, for convenience, been shown as a monochrome film. Multicolor images may be obtained by providing the requisite number of differentially exposable silver halide emulsions, and said silver halide emulsions are most commonly provided as individual layers coated in superposed relationship. Film units intended to provide multicolor images comprise two or more selectively sensitized silver halide layers each having associated therewith an appropriate image dye-providing material providing an image dye having spectral absorption characteristics substantially complementary to the light by which the associated silver halide is exposed. The most commonly employed negative components for forming multicolor images are of the "tripack" structure and contain blue-, green-, and red-sensitive silver halide layers each having associated therewith in the same or in a contiguous layer a yellow, a magenta and a cyan image dye-providing material, respectively. Interlayers or spacer layers may, if desired, be provided between the respective silver halide layers and associated image dye-providing materials or between other layers. Integral multicolor photosensitive elements of this general type are disclosed in U.S. Pat. No. 3,345,163 issued Oct. 3, 1967 to Edwin H. Land and Howard G. Rogers as well as in the previously noted U.S. Pat. Nos., e.g., in FIG. 9 of the aforementioned U.S. Pat. No. 2,983,606.

The image dye-providing materials which may be employed in such processes generally may be characterized as either (1) initially soluble or diffusible in the processing composition but are selectively rendered non-diffusible in an imagewise pattern as a function of development; or (2) initially insoluble or non-diffusible in the processing composition but which are selectively rendered diffusible or provide a diffusible product in an imagewise pattern as a function of development. These materials may be complete dyes or dye intermediates, e.g., color couplers. The requisite differential in mobility or solubility may, for example, be obtained by a chemical action such as a redox reaction or a coupling reaction.

As examples of initially soluble or diffusible materials and their application in color diffusion transfer, mention may be made of those disclosed, for example in U.S. Pat. Nos. 2,774,668; 2,968,554; 2,983,606; 3,087,817; 3,185,567; 3,230,082; 3,345,163; and 3,443,943. As examples of initially non-diffusible materials and their use in color transfer systems, mention may be made of the materials and systems disclosed in U.S. Pat. Nos. 3,185,567; 3,443,939; 3,443,940; 3,227,550; 3,227,552; 3,719,489; and 4,076,529. Both types of image dye-providing substances and film units useful therewith also are discussed in the aforementioned U.S. Pat. No. 3,647,437 to which reference may be made.

In the various color diffusion transfer systems which have previously been described, and which employ an aqueous alkaline processing fluid, it is well known to employ an acid-reacting reagent in a layer of the film unit to lower the environmental pH following substantial dye transfer in order to increase the image stability and/or to adjust the pH from the first pH at which the image dyes are diffusible to a second (lower) pH at which they are not. For example, the previously mentioned U.S. Pat. No. 3,415,644 discloses systems wherein the desired pH reduction may be effected by providing a polymeric acid layer adjacent the dyeable stratum. These polymeric acids may be polymers which contain acid groups, which are capable of forming salts with alkali metals or with organic bases; or potentially acid-yielding groups such as anhydrides or lactones. Preferably the acid polymer contains free carboxyl groups. Alternatively, or in addition, an acid-reacting reagent may be provided in a layer adjacent to the silver halide layer most distant from the image-receiving layer, as disclosed in U.S. Pat. No. 3,573,043 issued Mar. 30, 1971 to Edwin H. Land.

An interlayer or spacer layer may be and is preferably disposed between the polymeric acid layer and the dyeable stratum in order to control or "time" the pH reduction so that it is not premature and thus interfere with the development process. Suitable spacer or "timing" layers for this purpose are described with particularity in U.S. Pat. Nos. 3,362,819; 3,419,389; 3,421,893; 3,455,686 and 3,575,701.

The following examples which are intended to be illustrative and not limitative are included to provide a better understanding of the present invention. All parts and percentages are by weight unless otherwise indicated.

EXAMPLE 1

A photographic film unit adapted to the provision of a permanent photographic laminate was prepared in the following manner. A multicolor photosensitive element was prepared by coating the following layers, in succession, onto an opaque subcoated polyethylene terephthalate film base of approximately 0.127 mm thickness.

1. a polymeric acid layer comprising about 24,400 mgs/m$^2$ of the half butyl ester of ethylene maleic anhydride, about 4310 mgs/m$^2$ of polyvinyl butyral and about 89 mgs/m$^2$ of titanium dioxide;

2. a layer of styrene maleic anhydride copolymer coated at a coverage of about 400 mgs/m$^2$;

3. a timing layer comprising a 40/40/18/2 tetrapolymer of butyl acrylate/diacetone acrylamide/carbomethoxymethyl acrylate/acrylic acid coated at a coverage of about 2408 mgs./m.$^2$;

4. a cyan dye developer layer comprising about 511 mgs/m$^2$ of the cyan dye developer represented by the formula

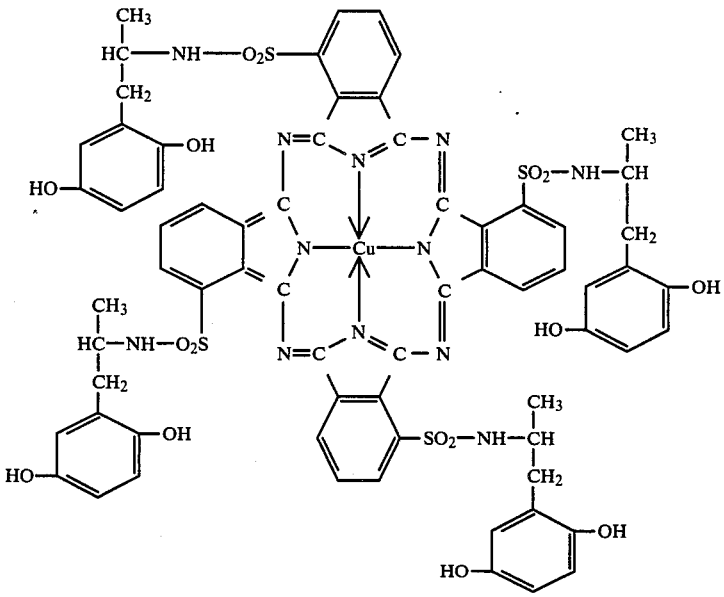

about 414 mgs/m$^2$ of gelatin, about 60 mgs./m$^2$ of 4'-methylphenyl hydroquinone (MPHQ), and about 108 mgs/m$^2$ of 1,3-bis[1-(4-hydroxyphenyl)-tetrazolyl-(5)-mercapto]-2-propanone oxime;

5. a layer comprising about 800 mgs/m$^2$ of titanium dioxide, about 375 mgs/m$^2$ of a 61/29/6/4/0.4 pentapolymer of butylacrylate/diacetone acrylamide/methylacrylic acid/styrene/acrylic acid, about 125 mgs/m$^2$ of gelatin and about 37.5 mgs/m$^2$ of polymethylmethacrylate;

6. a red-sensitive silver iodobromide layer comprising about 1300 mgs/m$^2$ of silver (1.5 microns) and about 816 mgs/m$^2$ of gelatin;

7. an interlayer comprising about 3554 mgs/m$^2$ of the pentapolymer described in layer 3 and about 187 mgs/m$^2$ of polyacrylamide;

8. a magenta dye developer layer comprising about 420 mgs/m$^2$ of the magenta dye developer represented by the formula

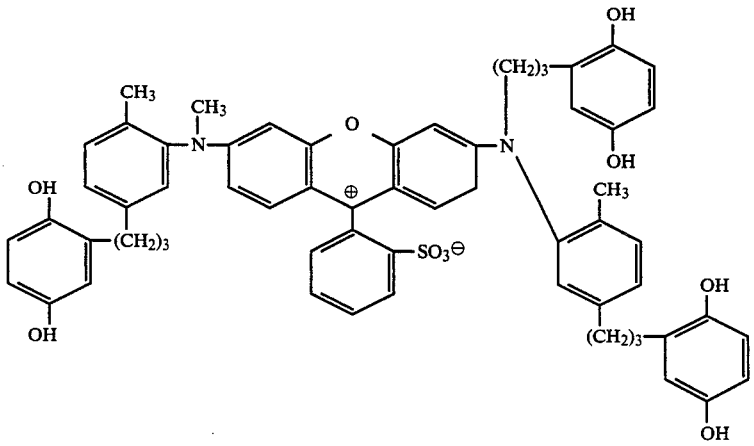

about 262 mgs/m$^2$ of gelatin, and about 500 mgs/m$^2$ of 2-phenylbenzimidazole and 50 mgs/m$^2$ of 1,3-bis[1-(4-hydroxyphenyl)-tetrazolyl-(5)-mercapto]-2-propanone oxime;

9. a layer comprising about 404 mgs/m$^2$ of Dow 620 (carboxylated styrene-butadiene copolymer) latex and about 135 mgs/m$^2$ of gelatin;

10. a green-sensitive silver halide emulsion layer comprising about 1176 mgs/m$^2$ of silver (1.8 microns), about 295 mgs/m$^2$ of silver (1.1 microns), about 566 mgs/m$^2$ of gelatin and about 260 mgs/m$^2$ of MPHQ;

11. a layer comprising about 1967 mgs/m$^2$ of the pentapolymer described in layer 3, about 103 mgs/m$^2$ of polyacrylamide and about 565 mgs/m$^2$ scavenger represented by the formula

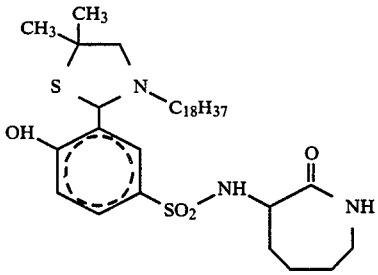

and 17 mgs/m$^2$ of succidialdehyde;

12. a layer comprising about 475 mgs/m$^2$ of benzidine yellow dye and about 143 mgs./m$^2$ of gelatin;

13. a yellow image dye-providing layer comprising about 1028 mgs/m$^2$ of a yellow image dye-providing material represented by the formula

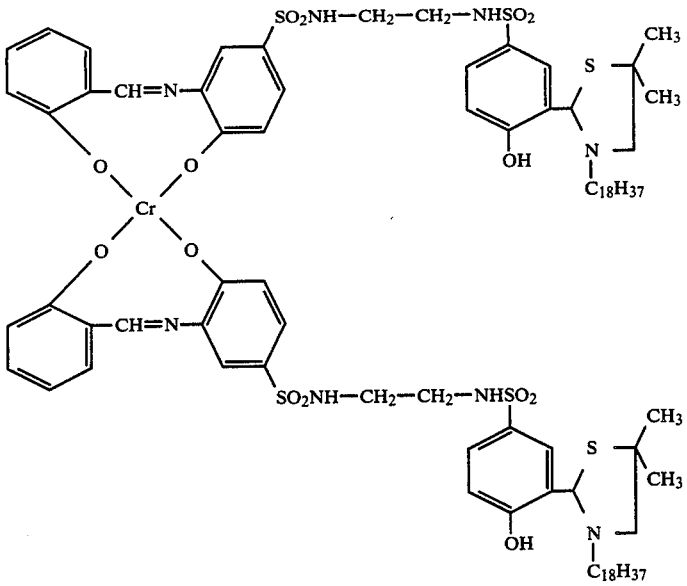

and about 411 mgs/m$^2$ of gelatin;

14. a layer comprising about 490 mgs/m$^2$ of phenyl tertiarybutyl hydroquinone and about 270 mgs/m$^2$ of gelatin;

15. a blue-sensitive silver iodobromide layer comprising about 232 mgs/m$^2$ of silver (1.6 microns), about 58 mgs/m$^2$ of silver (1.3 microns) and about 145 mgs/m$^2$ of gelatin; and 16. a gelatin layer coated at a coverage of about 800 mgs/m$^2$.

The image-receiving element comprised an approximately 2.7 mil (0.069 mm.) polyester film base, including a small amount of an anti-light piping dye, upon which there were coated in succession:

1. an image-receiving layer coated at a coverage of about 300 mgs/ft$^2$ (3229 mgs/m$^2$) of a graft copolymer comprised of 4-vinylpyridine (4VP) and vinyl benzyl trimethylammonium chloride (TMO) grafted onto hydroxyethyl cellulose (HEC) at ratios of HEC/4VP/TMQ of 2.2/2.2/1 and about 5 mgs/ft$^2$ (54 mgs/m$^2$) of 1,4-butanediol-diglycidyl ether; and 2. an overcoat layer coated at a coverage of about 85 mgs/ft$^2$ (915 mgs/m$^2$) comprising 1 part Igepal CO-997 (nonylphenoxyethylene oxide ethanol), 1 part of a 1.0/1.0/0.1/0.1 tetrapolymer of methacrylic acid/diacetone acrylamide/butyl acrylate/styrene and 0.3 part of polyvinylpyrrolidone.

The photosensitive element was placed in a superposed relation with the image-receiving element and a rupturable container (retaining an aqueous alkaline processing composition of the invention) was fixedly mounted at the leading edge of each of the elements, by pressure-sensitive tapes to make a film unit, so that, upon application of compressive force to the container to rupture the marginal seal of the container, the contents thereof would be distributed between the elements placed in a face-to-face relationship, i.e., with their respective supports outermost.

The aqueous alkaline processing composition (hereinafter Processing Composition PC-1) comprised the ingredients in the amounts (in parts by weight) stated in the following Table I.

TABLE I

| Ingredients | Parts By Weight |
|---|---|
| Water | 38.9 |
| Titanium dioxide (rutile) | 46.2 |
| Poly(diacetone acrylamide)oxime | 0.64 |
| Potassium hydroxide (50% aqueous solution) | 4.42 |
| Colloidal silica (30% aqueous dispersion) | 0.22 |
| Zonyl FSN (40% solids) | 0.19 |
| N—phenethyl-α-picolinium bromide (50% solids) | 1.39 |
| 6-methyluracil | 0.56 |
| 2-methylimidazole | 0.47 |
| Hypoxanthine | 0.55 |
| 1-(4-hydroxyphenyl)-1H—tetrazole-5-thiol | 0.02 |
| 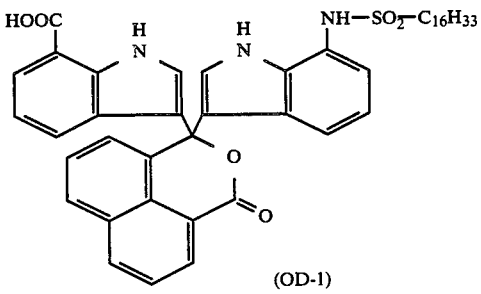 (OD-1) | 0.42 |

TABLE I-continued

| Ingredients | Parts By Weight |
|---|---|
| | 1.46 |

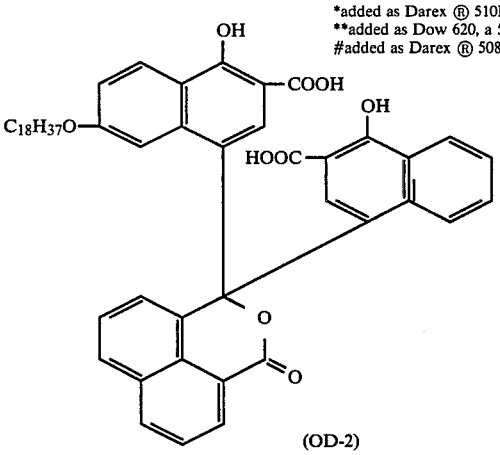

(OD-2)

| | |
|---|---|
| Carboxylated styrene-butadiene copolymer* | 4.62 |

*added as Darex ® 510L, a 55%-solids carboxylated, 67/33 styrene-butadiene latex of W. R. Grace & Co.

The film unit (referred to as Film Unit-A) was photoexposed through the image-receiving element using an exposure of two meter-candle seconds through a standardized wedge target. The processing composition was distributed between the elements of the film unit by passing the film unit between a pair of pressure-applying rolls having a gap of approximately 0.0028 inch (0.071 mm.). The resulting laminate was maintained intact to provide a multicolor integral negative-positive reflection print which exhibited good color quality and balance.

Film units of the aforedescribed type having dye developer and thiazolidine dye imaging systems are disclosed and claimed in the patent application of Peter O. Kliem U.S. Ser. No. 846,586, filed of even date.

EXAMPLES 2 TO 6

Processing compositions (referred to as Processing Compositions PC-2 to PC-6) were prepared containing commercially available carboxylated styrene-butadiene copolymer at varying concentrations. In addition, processing compositions having no such copolymer additive were prepared as controls (hereinafter, Control Processing Compositions CPC-A and CPC-B). The processing compositions were incorporated into rupturable containers for use in the manufacture of film units and contained the ingredients and amounts stated in the following Table II.

TABLE II

| Ingredients | PC-2 | CPC-A | PC-3 | PC-4 | PC-5 | PC-6 | CPC-B |
|---|---|---|---|---|---|---|---|
| Water | 39.4 | 40.8 | 40.3 | 40.4 | 39.7 | 39.0 | 40.9 |
| Titanium dioxide (rutile) | 46.9 | 48.4 | 47.9 | 48.0 | 48.0 | 47.0 | 48.7 |
| Poly(diacetone acrylamide) oxime | 0.65 | 0.67 | 0.66 | 0.66 | 0.66 | 0.65 | 0.67 |
| Potassium hydroxide (50% aq.) solution) | 4.48 | 4.62 | 4.42 | 4.31 | 4.30 | 4.22 | 4.49 |
| Colloidal silica (30% aq. dispersion) | 0.23 | 0.23 | 0.23 | 0.23 | 0.23 | 0.23 | 0.23 |
| Zonyl FSN (40% solids) | 0.19 | 0.20 | 0.20 | 0.19 | 0.19 | 0.19 | 0.20 |
| N—phenethyl-α-picolinium bromide 50% solids) | 1.41 | 1.46 | 1.44 | 1.44 | 1.44 | 1.41 | 1.46 |
| 6-methyluracil | 0.57 | 0.59 | 0.40 | 0.41 | 0.41 | 0.40 | 0.41 |
| 2-methylimidazole | 0.47 | 0.49 | 0.48 | 0.49 | 0.49 | 0.48 | 0.49 |
| Hypoxanthine | 0.56 | 0.58 | 0.45 | 0.46 | 0.46 | 0.45 | 0.46 |
| 1-(4-hydroxphenyl)-1-H—tetrazole-5-thiol) | 0.02 | 0.02 | 0.01 | 0.01 | 0.01 | 0.01 | 0.01 |
| OD-1 | 0.43 | 0.44 | 0.43 | 0.44 | 0.44 | 0.43 | 0.44 |
| OD-2 | 1.48 | 1.53 | 1.49 | 1.51 | 1.51 | 1.48 | 1.51 |
| Carboxylated styrene-butadiene copolymer | 3.12* | 0 | 1.50# | 1.48* | 2.16** | 4.02** | 0 |

*added as Darex ® 510L, a 55%-solids carboxylated 67/33 styrene-butadiene latex of W. R. Grace & Co.
**added as Dow 620, a 50%-solids carboxylated 67/33 styrene-butadiene latex of Dow Chemical Company.
#added as Darex ® 508L, a 55%-solids carboxylated 67/33 styrene-butadiene latex of W. R. Grace & Co.

EXAMPLE 7

Using photosensitive and image-receiving elements as described in EXAMPLE 1, and a processing composition having the composition (PC-2) described in Table II, a film unit (Film Unit-B) was prepared and processed in the manner described in EXAMPLE 1. As a control, a film unit (Film Unit C-1) was prepared and processed in the same manner, except that there was employed as the processing composition, a composition (CPC-A) having no addition of carboxylated styrene-butadiene copolymer and identified in Table II. In the case of each of Film Units B and C-1, there were obtained upon processing multicolor integral positive-negative reflection prints which exhibited good color quality and balance.

EXAMPLES 8 TO 11

A series of film units (Film Units D through G) were prepared in the manner described in EXAMPLE 1 except that, in the photosensitive element, the timing layer (layer #3) was coated at a coverage of about 2207 mgs/m$^2$; and Processing Compositions PC-3 through PC-6 (identified in Table II) were used as the processing compositions for Film Units D through G, respectively. A control film unit (Film Unit C-2) was prepared in the same manner, except that there was employed as the processing composition, a composition (CPC-B) having no addition of carboxylated styrene-butadiene copolymer and identified in Table II. By processing Fim Units D through G and the control (Film Unit C-2) in the manner described in EXAMPLE 1, there was obtained in each instance an integral positive-negative reflection print which exhibited good color quality and balance.

EXAMPLE 12

Integral positive-negative reflection prints (hereinafter photographic laminates) obtained from Film Units A and B and Control Film Unit C-1 were subjected to comparative evaluation for a determination of the tendency of each of the photographic laminates to delaminate upon application of a force at the interface of the laminate sheets. The adhesion capacity of each of the photographic laminates was determined by slitting the laminate at the interface of the laminated sheets to initiate a partial separation of the sheets, positioning a razor-edged blade at the interface of the partially separated sheets, applying a measured force onto the blade in a manner to force further delamination of the sheets, and recording the amount of force (in grams) required to cause the further delamination (referred to as Peel Force in Table III). Each of the photographic laminates had been dried for two weeks at 120° F. (49° C.) prior to the evaluation. A series of replications was performed for each of the photograhic laminates obtained from each of Film Units A and B and Control Film Unit C-1 (ten readings in the case of Film Unit A; seven for Film Unit B; and five for Control Film Unit C-1). In Table III is reported the range of peel force values in each instance and the average of the values.

TABLE III

| Film Unit | Processing Composition | Peel Force (in grams) Range | Average |
|---|---|---|---|
| A | PC-1 (4.62% copolymer) | 340–370 | 359 |
| B | PC-2 (3.12% copolymer) | 260–280 | 272 |
| C-1 | CPC-A (no copolymer) | 80–90 | 82 |

From a comparision of the peel force data presented in Table III, it will be seen that an average of 82 grams of force effected a delamination in the photographic laminates obtained from the control film unit (C-1), based upon a processing composition (CPC-A) which contained no carboxylated styrene-butadiene copolymer; that a measure of protection against delamination was provided by the incorporation of a carboxylated styrene-butadiene copolymer at the 3.12% level in Processing Composition PC-2, in that an average of 272 grams of force was required to effect delamination of the photographic laminates obtained from Film Unit B; and that further protection was afforded (an average of 359 grams peel force) by an increase of the level of the copolymer in Processing Composition PC-2 to 4.62% (PC-1).

EXAMPLE 13

Photographic laminates obtained from Film Units D, E, F and G and from the corresponding Control Film Unit (C-2) were subjected to peel-force evaluation in the manner described hereinbefore, with the results reported in Table IV as follows.

TABLE IV

| Film Unit | Processing Composition | Peel Force (in grams) |
|---|---|---|
| D | PC-3 (1.5% copolymer) | 156 |
| E | PC-4 (1.48% copolymer) | 148 |
| F | PC-5 (2.16% copolymer) | 252 |
| G | PC-6 (4.02% copolymer) | 450 |
| C-2 | CPC-B (no copolymer) | 88 |

EXAMPLE 14

The integral positive-negative reflection prints obtained by the processing of Film Units A and B (and corresponding COntrol Film Unit C-1) and by the processing of Film Units D,E,F and G (amd corresponding Control Film Unit C-2) were evaluated for sensitometric response by measurement on a desitometer of the neutral density columns of the images to obtain $D_{min}$ and $D_{max}$ values for red, green and blue, respectively. The results are reported as follows in Table IV.

TABLE IV

| Film Unit | $D_{min}$ R | G | B | $D_{max}$ R | G | B |
|---|---|---|---|---|---|---|
| A | 0.11 | 0.09 | 0.11 | 1.48 | 1.63 | 1.73 |
| B | 0.11 | 0.09 | 0.11 | 1.47 | 1.64 | 1.75 |
| C-1 | 0.11 | 0.10 | 0.12 | 1.44 | 1.65 | 1.84 |
| D | 0.08 | 0.10 | 0.10 | 1.53 | 1.86 | 1.74 |
| E | 0.08 | 0.10 | 0.11 | 1.69 | 1.98 | 1.75 |
| F | 0.08 | 0.09 | 0.11 | 1.63 | 1.97 | 1.76 |
| G | 0.09 | 0.10 | 0.11 | 1.53 | 1.84 | 1.66 |
| C-2 | 0.08 | 0.10 | 0.10 | 1.51 | 1.87 | 1.75 |

The invention has been described in detail with particular reference to preferred embodiments thereof. It will be understood, however, that variations and modifications can be effected. For example, in the photographic film units of the invention, there can be employed as an image-receiving element, an image-receiving element having improved clarity and having the structure and composition of the image-receiving element recited in EXAMPLE 1 hereof, except, having in place of layer 2 thereof, an overcoat layer coated at a coverage of about 1292 mgs/m$^2$ and comprising one part of polyvinyl hydrogen phthalate, potassium salt and one part of a 1/1/0.35 mixture of Igepal CO-997 (nonylphenoxyethylene oxide ethanol), a 1.0/1.0/0.1/0.1 tetrapolymer of methacrylic acid/diacetone acrylamide/butyl acrylate/styrene, and 0.35 part of polyvinylpyrrolidone. Other salts (such as the lithium, sodium, or preferably the ammonium salt) can be employed in place of the potassium polyvinyl hydrogen phthalate salt. Relative proportions of the components of the overcoat, image-receiving or other layers can be varied to suit particular requirements or desired photographic performance or for ease of manufacture. The layers of the image-receiving element can be coated in sequence, or preferably, can be applied simultaneously. Any of a variety of mordanting materials can be employed in the image-receiving layer of such image-receiving elements. Other modifications and variations can, however, be accomplished within the scope and spirit of the present invention.

What is claimed is:

1. A photographic processing composition comprising an aqueous alkaline medium having therein:

a polymeric oxime viscosity-increasing agent comprising recurring units of the formula

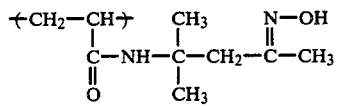

said polymeric oxime viscosity-increasing agent being present in an amount in the range of about 0.5% to about 1% by weight of the composition;

a light-reflecting pigment; and a carboxylated styrene-butadiene latex, said carboxylated styrene-butadiene latex being present in an amount in the range of about 1.5% to about 3% by weight of the composition.

2. The photographic processing composition of claim 1 wherein said light-reflecting pigment is present in an amount in the range of about 35% to about 60% by weight of the composition.

3. The photographic processing composition of claim 2 wherein said light-reflecting pigment is titanium dioxide.

4. A photographic product for forming a diffusion transfer image within a permanent laminate comprising, in combination, a first support carrying at least one photosensitive silver emulsion layer, each said silver halide emulsion having associated therewith an image-forming material; a second support carrying an image-receining layer; and a photographic processing composition adapted to be distributed between the silver halide layer or layers and the image-receiving layer and effective to develop the silver halide emulsion or emulsions after photoexposure and form a transfer image in said image-receiving layer and effective to mask the developed silver halide layer or layers and provide a light-reflecting background for the viewing of said transfer image, said photographic processing composition comprising an aqueous alkaline medium having therein:

a polymeric oxime viscosity-increasing agent comprising recurring units of the formula

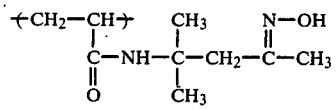

said polymeric oxime viscosity-increasing agent being present in an amount in the range of about 0.5% to about 1% by weight of the composition;

a light-reflecting pigment; and a carboxylated styrene-butadiene latex, said carboxylated styrene-butadiene latex being present in an amount in the range of about 1.5% to about 3% by weight of the composition.

5. The photographic product of claim 4 wherein said photographic processing composition is present in a rupturable container positioned to distribute said processing composition between said image-receiving layer and said silver halide emulsion layer or layers.

6. The photographic product of claim 4 wherein said light-reflecting pigment is present in said processing composition in an amount in the range of about 35% to about 60% by weight of the composition.

7. The photographic product of claim 4 wherein said support carrying said image-receiving layer is a sheet of polyethylene terephthalate.

8. The photographic product of claim 4 wherein each of said first and second supports is a sheet of polyethylene terephthalate.

9. The photographic product of claim 6 wherein said light-reflecting pigment comprises titanium dioxide.

* * * * *